US010712091B2

(12) United States Patent
Zhou

(10) Patent No.: US 10,712,091 B2
(45) Date of Patent: Jul. 14, 2020

(54) WATER DRYING CONTROL SYSTEM FOR REFINED COTTON

(71) Applicant: HUBEI JINHANJIANG REFINED COTTON CO., LTD., Zhongxiang, Hubei (CN)

(72) Inventor: Hangxu Zhou, Hubei (CN)

(73) Assignee: HUBEI JINHANJIANG REFINED COTTON CO., LTD. (CN)

( * ) Notice: Subject to any disclaimer, the term of this patent is extended or adjusted under 35 U.S.C. 154(b) by 187 days.

(21) Appl. No.: 15/921,593

(22) Filed: Mar. 14, 2018

(65) Prior Publication Data

US 2018/0266765 A1 Sep. 20, 2018

(30) Foreign Application Priority Data

Mar. 18, 2017 (CN) ..... 2017 1 0162600

(51) Int. Cl.
*F26B 25/22* (2006.01)
*D06B 15/02* (2006.01)
(Continued)

(52) U.S. Cl.
CPC ..... *F26B 25/22* (2013.01); *D06B 15/02* (2013.01); *D06B 15/09* (2013.01); *D06B 23/22* (2013.01); *F26B 3/06* (2013.01); *F26B 5/14* (2013.01); *F26B 7/00* (2013.01); *F26B 17/10* (2013.01); *D10B 2201/02* (2013.01)

(58) Field of Classification Search
CPC ..... D06B 15/02; D06B 15/09; D06B 23/22; D06B 2201/02; F26B 17/10; F26B 25/22; F26B 3/06; F26B 5/14; F26B 7/00
See application file for complete search history.

(56) References Cited

U.S. PATENT DOCUMENTS 3,256,614 A * 6/1966 Dunbar ..... F26B 17/10 34/549

FOREIGN PATENT DOCUMENTS

CN 104160232 A 11/2014
CN 104160232 B * 2/2016 ..... F26B 21/10
(Continued)

OTHER PUBLICATIONS

English translation of office action for application No. 201710162600.1 from The People's Republic of China (Year: 2018).*
(Continued)

*Primary Examiner* — Jorge A Pereiro
*Assistant Examiner* — Logan P Jones

(57) ABSTRACT

The present invention relates to a water drying control system for refined cotton. The system comprises a pressing machine and a heat exchanger, a back end part of the pressing machine is provided with a discharge opening, and the system further comprises a control box, a main flap valve, a main drying pipe, a first drying cup, a second drying cup, a first cyclone separator, a first flap valve, a first draught fan, a third drying cup, a fourth drying cup, a second cyclone separator, a second flap valve, a second draught fan, a first infrared ray moisture transducer, a second infrared ray moisture transducer and a third infrared ray moisture transducer. Hot air can be supplemented to change the drying intensity and control the moisture content of the refined cotton of each stage in a reasonable scope, so as to effectively increase the performance.

2 Claims, 1 Drawing Sheet

(51) Int. Cl.

| | |
|---|---|
| ***D06B 23/22*** | (2006.01) |
| ***F26B 7/00*** | (2006.01) |
| ***F26B 5/14*** | (2006.01) |
| ***F26B 17/10*** | (2006.01) |
| ***D06B 15/09*** | (2006.01) |
| ***F26B 3/06*** | (2006.01) |
| ***D06B 15/00*** | (2006.01) |
| ***F26B 21/00*** | (2006.01) |

(56) References Cited

FOREIGN PATENT DOCUMENTS

| | | | |
|---|---|---|---|
| CN | 205035515 U | * | 2/2016 |
| CN | 205035515 U | | 2/2016 |

OTHER PUBLICATIONS

SIPO, First Office Action, dated Feb. 1, 2019, Application No./Patent No. 201710162600.1.

SIPO, Second Office Action, dated Jul. 24, 2019, Application No./Patent No. 201710162600.1.

Jiangxi Forestry Research Institute, "Fiber Air Drying and Fiber Grading", Manual of Wood-based Panel Production, Sep. 1977, pp. 431-439, Agriculture Press, China.

* cited by examiner

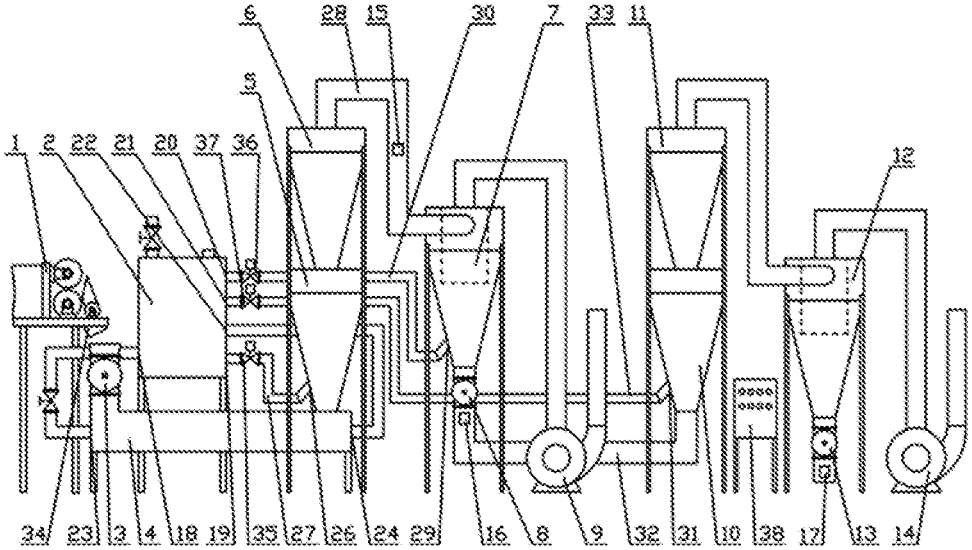
6
28
15
30
7
33
11
5
1
2
22
21
20
37
36
12
34
23
3
4
18
19
35
27
26
24
29
16
8
9
32
31
10
38
17
13
14

WATER DRYING CONTROL SYSTEM FOR REFINED COTTON

FIELD

The present invention relates to the field of drying system technologies, and more particularly, to a water drying control system for refined cotton.

BACKGROUND

The refined cotton is made by cotton opening, pre-dipping, boiling, bleaching, drying and the processes with the cotton linter as the material. The refined cotton is non-toxic and tasteless, and is easy to absorb water. The refined cotton is the main material for manufacturing ether cellulose, nitrated cellulose and cellulose acetate, is widely applied in food, medicine, daily use chemical, plastic, electronics, papermaking, metallurgy, aerospace and other fields, and is honored as "Industrial Aginomoto".

Since the refined cotton contains a lot of water after bleaching, the refined cotton needs to be dehydrated and dried through pressing to control the moisture in the scope of 6-8%. At present an airflow drying mode is generally used to control the moisture to the refined cotton, but since there is not monitoring equipment, the moisture content is usually difficult to be accurately controlled, which causes the contradiction that too low moisture affects the enterprise revenue and the customer cannot accept the refined cotton with too high moisture.

SUMMARY

The object of the invention is to provide a water drying control system for refined cotton that can accurately control the drying effect of each cycle, makes sure that the moisture content of the refined cotton at each stage is always in a controlled scope, and effectively guarantees the drying effect, so as to solve the deficiency above.

The technical solutions used by the invention to solve the technical problem above are as follows.

A water drying control system for refined cotton comprises a pressing machine and a heat exchanger, the back end part of the pressing machine is provided with a discharge opening, and the water drying control system for refined cotton further comprises a control box, a main flap valve, a main drying pipe, a first drying cup, a second drying cup, a first cyclone separator, a first flap valve, a first draught fan, a third drying cup, a fourth drying cup, a second cyclone separator, a second flap valve, a second draught fan, a first infrared ray moisture transducer, a second infrared ray moisture transducer and a third infrared ray moisture transducer, the main flap valve is communicated with the front end of the main drying pipe, the discharge opening of the pressing machine is corresponding to the main flap valve, the heat exchanger is respectively provided with a first air outlet, a second air outlet, a third air outlet, a fourth air outlet and a air-return port, the main drying pipe is respectively provided with a wind inlet and a wind outlet, the first air outlet of the heat exchanger is communicated with the wind inlet of the main drying pipe, the air-return port is communicated with the wind outlet, the second drying cup is overlapped on the first drying cup and is communicated with the first drying cup, the lower part of the first drying cup is provided with a first wind-supplement port, the bottom part of the first drying cup is communicated with the back end pan of the main drying pipe, the second air outlet of the heat exchanger is communicated with the first wind supplement port of the first drying cup through a first wind supplement pipe, the upper side part of the first cyclone separator is communicated with the top part of the second drying cup through a first feed delivery pipe, the first infrared ray moisture transducer is installed in the first feed delivery pipe, the lower part of the first cyclone separator is provided with a second wind supplement port, the third air outlet of the heat exchanger is communicated with the second wind supplement port through the second wind supplement pipe, the first flap valve is communicated with the bottom part of the first cyclone separator, the first draught fan is communicated with the top part of the first cyclone separator, the fourth drying cup is overlapped on the third drying cup and is communicated with the third drying cup, the lower part of the third drying cup is provided with a third wind supplement port, the bottom part of the third drying cup is communicated with the first flap valve through a second feed delivery pipe, the second infrared ray moisture transducer is installed in the second feed delivery pipe, the fourth air outlet of the heat exchanger is communicated with the third wind supplement port of the third drying cup through the third wind supplement pipe, the upper side part of the second cyclone separator is communicated with the top part of the fourth drying cup, the second flap valve is communicated with the bottom part of the second cyclone separator, the third infrared ray moisture transducer is installed in the second flap valve, the second draught fan is communicated with the top part of the second cyclone separator, the first wind supplement pipe, the second wind supplement pipe and the third wind supplement pipe are respectively provided with a first motorized valve, a second motorized valve and a third motorized valve, aid the control box is electrically connected to the pressing machine, the first motorized valve, the second motorized valve, the third motorized valve, the first infrared ray moisture transducer, the second infrared ray moisture transducer and the third infrared ray moisture transducer respectively.

The first wind supplement pipe, the second wind supplement pipe and the third wind supplement pipe at the first wind supplement port, the second wind supplement port and the third wind supplement port are respectively set towards an obliquely upward direction.

Through using the technical solution above, the invention can reach the beneficial effect as follows.

1. The infrared ray moisture transducers are respectively installed in the feed delivery pipe and the flap valve to monitor the moisture content of the refined cotton of each stage in the drying system, when the moisture content of the product at any stage does not reach the standard, hot air can be supplemented in the drying cup and the cyclone separator corresponding to the transducer through a wind pipe to change the drying intensity and control the moisture content of the refined cotton of each stage in a reasonable scope, so as to effectively increase the performance of enterprises.

2. the moisture data monitored by the transducer is transmitted to a control circuit in the control box, the control circuit controls the flow of each motorized valve to change the amount of heat supply of each wind pipe, so as to achieve the object of controlling the diving effect of each stage in the drying system, so that the moisture content of finally dried refined cotton meets the requirement of technical standard 3. the control circuit in the control box can also accurately control the moisture content of the material through controlling the rotate speed of the pressing machine, that is, through controlling the flow of the material in the drying system.

BRIEF DESCRIPTION OF THE DRAWINGS

FIG. 1 is a schematic diagram of the structure of the patent.

DETAILED DESCRIPTION

As shown in FIG. 1, a water drying control system for refined cotton comprises a pressing machine 1 and a heat exchanger 2, wherein the back end part of the pressing machine 1 is provided with a discharge opening 34, and the water drying control system for refined cotton further comprises a control box 38, a main flap valve 3, a main drying pipe 4, a first drying cup 5, a second drying cup 6, a first cyclone separator 7, a first flap valve 8, a first draught fan 9, a third drying cup 10, a fourth drying cup 11, a second cyclone separator 12, a second flap valve 13, a second draught fan 14, a first infrared ray moisture transducer 15, a second infrared ray moisture transducer 16 and a third infrared ray moisture transducer 17, and the equipment or device above is common equipment or device used in production of refined cotton, and can be directly purchased from the market. The main flap valve 3 is communicated with the front end of the main drying pipe 4, the discharge opening 34 of the pressing machine 1 is corresponding to the main flap valve 3, most moisture in the refined cotton can be removed after pressing and dehydrating through the pressing machine 1, and then the refined cotton falls into the main drying pipe 4 through the main flap valve 3 from the discharge opening 34. The heat exchanger 2 is respectively provided with a first air outlet 18, a second air outlet 19, a third air outlet 20, a fourth air outlet 21 and a air-return port 22, the main drying pipe 4 is respectively provided with a wind inlet 23 and a wind outlet 24, the first air outlet 18 of the heat exchanger 2 is communicated with the wind inlet 23 of the main drying pipe 4, the air-return port 22 is communicated with the wind outlet 24, the air is discharged from the first air outlet 18 after heating by the heat exchanger 2, and enters the main drying pipe 4 from the wind inlet 23 to dry the refined cotton, the dried hot air is discharged from the wind outlet 24, and is heated again in the heat exchanger 2 after returning through the air-return port 22, the heated hot air enters the main drying pipe 4 again to recycle repeatedly, and the power required for airflow comes from the inertia force of airflow provided for suction to the refined cotton in the main drying pipe 4 conducted by the first draught fan 9 and the second draught fan 14. The second drying cup 6 is overlapped on the first drying cup 5 and is communicated with the first drying cup 5, the lower part of the first drying cup 5 is provided with a first wind-supplement port 26, the bottom part of the first drying cup 5 is communicated with the back end part of the main drying pipe 4, the refined cotton is preliminarily dried in the main drying pipe 4 to remove most moisture in the refined cotton, and the preliminarily dried refined cotton enters the first drying cup 5 from the back end part of the main drying pipe 4. The second air outlet 19 of the heat exchanger 2 is communicated with the first wind supplement port 26 of the first drying cup 5 through a first wind supplement pipe 27, and the first wind supplement pipe 27 is provided with a first motorized valve 35. The upper side part of the first cyclone separator 7 is communicated with the top part of the second drying cup 6 through a first feed delivery pipe 28, the first infrared ray moisture transducer 15 is installed in the first feed delivery pipe 28, the moisture content of the refined cotton here is detected through the first infrared ray moisture transducer 15, if the moisture content of the refined cotton at the moment is too large, the hot air is supplied in the first drying cup 5 through the first wind supplement pipe 27 to increase the drying intensity of the refined cotton in the first drying cup 5 and the second drying cup 6, or the discharge speed of the pressing machine 1 is adjusted, and the quantity of the refined cotton entering the main drying pipe 4 is controlled to control the drying effect. the lower part of the first cyclone separator 7 is provided with a second wind supplement port 29, the third air outlet 20 of the heat exchanger 2 is communicated with the second wind supplement port 29 through the second wind supplement pipe 30, the second wind supplement pipe 30 is provided with a second motorized valve 36, the first flap valve 8 is communicated with the bottom part of the first cyclone separator 7, and the first draught fan 9 is communicated with the top part of the first cyclone separator 7. The fourth drying cup 11 is overlapped on the third drying cup 10 and is communicated with the third drying cup 10, the lower part of the third drying cup 10 is provided with a third wind supplement port 31, the bottom part of the third drying cup 10 is communicated with the first flap valve 8 through a second feed delivery pipe 32, and the second infrared ray moisture transducer 16 is installed in the second feed delivery pipe 32. The moisture content of the refined cotton here is detected through the second infrared ray moisture transducer 16, and if the moisture content of the refined cotton at the moment is too large, the hot air is supplied into the first cyclone separator 7 through the second wind supplement pipe 30, so as to increase the drying intensity of the refined cotton in the first cyclone separator 7. The second air outlet 21 of the heat exchanger 2 is communicated with the third wind supplement port 31 of the third drying cup 10 through a third wind supplement pipe 33, and the third wind supplement pipe 33 is provided with a third motorized valve 37. The upper side part of the second cyclone separator 12 is communicated with the top part of the fourth drying cup 11, the second flap valve 13 is communicated with the bottom part of the second cyclone separator 12, and the refined cotton is discharged from the second flap valve 13 after successively passing through the first drying cup 5, the second drying cup 6, the first cyclone separator 7, the first flap valve 8, the third drying cup 10, the fourth drying cup 11 and the second cyclone separator 12. The third infrared ray moisture transducer 17 is installed in the second flap valve 13, the moisture content of the refined cotton here is detected through the third infrared ray moisture transducer 17, and if the moisture content of the refined cotton at the moment is too large, the hot air is supplied into the third drying cup 10 through the third wind supplement pipe 33, so as to increase the drying intensity of the refined cotton in the third drying cup 10 and the fourth drying cup 11, and finally, the moisture content of the refined cotton meets the requirement on the technical standard. The second draught fan 14 is communicated with the top part of the second cyclone separator 12, and the refined cotton is movably delivered in the drying system under the suction effect of the first draught fan 9 and the second draught fan 14. The control box 38 is electrically connected to the pressing machine 1, the first motorized valve 35, the second motorized valve 36, the third motorized valve 37, the first infrared ray moisture transducer 15, the second infrared ray moisture transducer 16 and the third infrared ray moisture transducer 17 respectively. The control box 38 receives the signals from the first infrared ray moisture transducer 15, the second infrared ray moisture transducer 16 and the third infrared ray moisture transducer 17, and controls the pressing machine 1, the first motorized valve 35, the second motorized valve 36, the third motorized valve 37. The first wind supplement pipe 27, the second wind supplement pipe 30 and the third wind supplement pipe 33 at the first wind supplement port 26, the second wind supplement port 29 and the third wind supplement port 31 are respectively set towards an obliquely upward direction, so that the hot air entering the first drying cup 5, the first cyclone separator 7 and the third drying cup 10 is blew off towards an obliquely upward direction to blow away the refined cotton piled at the bottom, so as to increase the drying effect.

What is claimed is:

1. A water drying control system for refined cotton, comprising a pressing machine and a heat exchanger, wherein a back end part of the pressing machine is provided with a discharge opening, and the water drying control system for refined cotton further comprises a control box, a main flap valve, a main drying pipe, a first drying cup, a second drying cup, a first cyclone separator, a first flap valve, a first draught fan, a third drying cup, a fourth drying cup, a second cyclone separator, a second flap valve, a second draught fan, a first infrared ray moisture transducer, a second infrared ray moisture transducer and a third infrared ray moisture transducer;

the main flap valve is communicated with a front end of the main drying pipe, the discharge opening of the pressing machine is corresponding to the main flap valve, the heat exchanger is respectively provided with a first air outlet, a second air outlet, a third air outlet, a fourth air outlet and an air-return port, the main drying pipe is respectively provided with a wind inlet and a wind outlet, the first air outlet of the heat exchanger is communicated with the wind inlet of the main drying pipe, the air-return port is communicated with the wind outlet, the second drying cup is overlapped on the first drying cup and is communicated with the first drying cup, a lower part of the first drying cup is provided with a first wind-supplement port, a bottom part of the first drying cup is communicated with a back end part of the main drying pipe, the second air outlet of the heat exchanger is communicated with the first wind supplement port of the first drying cup through a first wind supplement pipe, an upper side part of the first cyclone separator is communicated with a top part of the second drying cup through a first feed delivery pipe, the first infrared ray moisture transducer is installed in the first feed delivery pipe, a lower part of the first cyclone separator is provided with a second wind supplement port, the third air outlet of the heat exchanger is communicated with the second wind supplement port through a second wind supplement pipe, the first flap valve is communicated with a bottom part of the first cyclone separator, the first draught fan is communicated with a top part of the first cyclone separator, the fourth drying cup is overlapped on the third drying cup and is communicated with the third drying cup, a lower part of the third drying cup is provided with a third wind supplement port, a bottom part of the third drying cup is communicated with the first flap valve through a second feed delivery pipe, the second infrared ray moisture transducer is installed in the second feed delivery pipe, the fourth air outlet of the heat exchanger is communicated with the third wind supplement port of the third drying cup through a third wind supplement pipe, an upper side part of the second cyclone separator is communicated with a top part of the fourth drying cup, the second flap valve is communicated with a bottom part of the second cyclone separator, the third infrared ray moisture transducer is installed in the second flap valve, the second draught fan is communicated with a top part of the second cyclone separator, the first wind supplement pipe, the second wind supplement pipe and the third wind supplement pipe are respectively provided with a first motorized valve, a second motorized valve and a third motorized valve, and the control box is electrically connected to the pressing machine, the first motorized valve, the second motorized valve, the third motorized valve, the first infrared ray moisture transducer, the second infrared ray moisture transducer and the third infrared ray moisture transducer respectively.

2. The water drying control system for refined cotton according to claim 1, wherein, the first wind supplement pipe, the second wind supplement pipe and the third wind supplement pipe at the first wind supplement port, the second wind supplement port and the third wind supplement port are respectively set towards an obliquely upward direction.

* * * * *